US007852301B2

(12) United States Patent
Chiou et al.

(10) Patent No.: US 7,852,301 B2
(45) Date of Patent: Dec. 14, 2010

(54) PIXEL CIRCUIT

(75) Inventors: Yu-Wen Chiou, Tainan County (TW); Chen-Yu Wang, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 697 days.

(21) Appl. No.: 11/871,613

(22) Filed: Oct. 12, 2007

(65) Prior Publication Data

US 2009/0096721 A1 Apr. 16, 2009

(51) Int. Cl.
*G09G 3/32* (2006.01)

(52) U.S. Cl. ..... 345/82; 345/76

(58) Field of Classification Search ..... 345/82, 345/83, 76, 87, 204; 315/169.1–169.4
See application file for complete search history.

(56) References Cited

U.S. PATENT DOCUMENTS 7,750,875 B2 * 7/2010 Kim et al. ..... 345/82
7,777,698 B2 * 8/2010 Takahara et al. ..... 345/76
2005/0030264 A1 * 2/2005 Tsuge et al. ..... 345/76
2005/0057580 A1 * 3/2005 Yamano et al. ..... 345/690
2005/0180083 A1 * 8/2005 Takahara et al. ..... 361/152
2006/0187153 A1 * 8/2006 Nathan et al. ..... 345/76
2008/0088549 A1 * 4/2008 Nathan et al. ..... 345/80

* cited by examiner

*Primary Examiner*—Ricardo L Osorio

(57) ABSTRACT

A pixel circuit has a light emitting diode, a driving transistor, a capacitor, a first switch, a second switch, a third switch, and a forth switch. The driving transistor has a drain, coupled to a second end of the light emitting diode. The capacitor is coupled between a gate of the driving transistor and the ground terminal. The third switch is coupled between the source and the gate of the driving transistor. The fourth switch is coupled between the second end of the light emitting diode and a data line. The first switch is off, the second is on, and the third is on during the reset period; the first switch is off, the second is off, and the third is on during the programming period; and the first switch is on, the second is on, and the third is off during the display period.

21 Claims, 7 Drawing Sheets

PIXEL CIRCUIT

BACKGROUND

1. Field of Invention

The present invention relates to a pixel circuit, and more particularly relates to an AMOLED compensation pixel circuit.

2. Description of Related Art

FIG. 1 shows an organic light emitting diode pixel circuit of the prior art. The pixel circuit is a voltage type pixel circuit. The pixel circuit has a light emitting diode 110, a driving transistor 130, a capacitor 150, a first switch 125, a second switch 145, a third switch 160, and a forth switch 170. A drain 136 of the driving transistor 130 is coupled to a second end 118 of the light emitting diode 110 through the first switch 125. The second switch 145 is coupled between a source 132 of the driving transistor 130 and a power source terminal 140. The capacitor 150 is coupled between a gate 134 of the driving transistor 130 and the ground terminal 120. The third switch 160, controlled by a first scan signal (SCAN1), is coupled between the source 132 and the gate 134 of the driving transistor 130. The fourth switch 170, also controlled by the first scan signal (SCAN1), is coupled between the second end 118 of the light emitting diode 110 and a data line 180.

The first switch 125 and the second switch 145 are controlled by the second scan signal (SCAN2). The second switch 145 is to couple or decouple the source 132 of the driving transistor 130 and the power source terminal 140. The first switch 125, the second switch 145, the third switch 160, and the fourth switch 170 are transistors.

The pixel circuit operates in a reset period, a programming period, and a display period sequentially. During the reset period, all of the four switches are turned on; during the programming period, the first switch 125 is turned off, the second switch 145 is turned off, the third switch 160 is turned on, and the forth switch 170 is turned on; during the display period, the first switch 125 is turned on, the second switch 145 is turned on, the third switch 160 is turned off, and the forth switch 170 is turned off. The first scan signal (SCAN1) is asserted to turn on the third switch 160 and the forth switch 170 during the reset period and the programming period, and de-asserted to turn off the third switch 160 and the forth switch 170 during the display period. Hence, the data signals (VDATA) from the data line 180 are transmitted to the pixel circuit during the programming period The drawback of the conventional pixel circuit is as follows. The pixel circuit has small aperture ratio since it has five transistors and one capacitor. Also, during the reset period, there is current flowing from the power source terminal 140 to the data line 180, then to the ground terminal 120. Besides, the pixel circuit has large power consumption since the power path involves three transistors, including the second switch 145, the driving transistor 130, and the first switch 125.

SUMMARY

According to one embodiment of the present invention, the pixel circuit has a light emitting diode, a driving transistor, a capacitor, a first switch, a second switch, a third switch, and a forth switch. The pixel circuit operates in a reset period, a programming period, and a display period sequentially. The first switch is coupled between a first end of the light emitting diode and a ground terminal. The driving transistor has a drain, coupled to a second end of the light emitting diode. The second switch is coupled between a source of the driving transistor and a power source terminal. The capacitor is coupled between a gate of the driving transistor and the ground terminal. The third switch, controlled by a first scan signal, is coupled between the source and the gate of the driving transistor. The fourth switch is coupled between the second end of the light emitting diode and a data line. The first switch is turned off, the second switch is turned on, and the third switch is turned on during the reset period; the first switch is turned off, the second switch is turned off, and the third switch is turned on during the programming period; and the first switch is turned on, the second switch is turned on, and the third switch is turned off during the display period.

According to another embodiment of the present invention, the pixel circuit has a light emitting diode, a driving transistor, a capacitor, a third switch, and a forth switch. The pixel circuit operates in a reset period, a programming period, and a display period sequentially. The light emitting diode is coupled to a ground terminal by the first switch. The first switch is turned off during the reset and programming period, and turned on during the display period. The driving transistor has a source and a drain, respectively coupled to a power source terminal by a second switch and a positive pole of the light emitting diode. The second switch is turned off during the programming period, and turned on during the reset and display period. The capacitor is coupled between a gate of the driving transistor and a reference voltage terminal. The third switch couples the source and the gate of the driving transistor together when a first scan signal is asserted. The first scan signal is asserted during the reset and programming period, and de-asserted during the display period.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
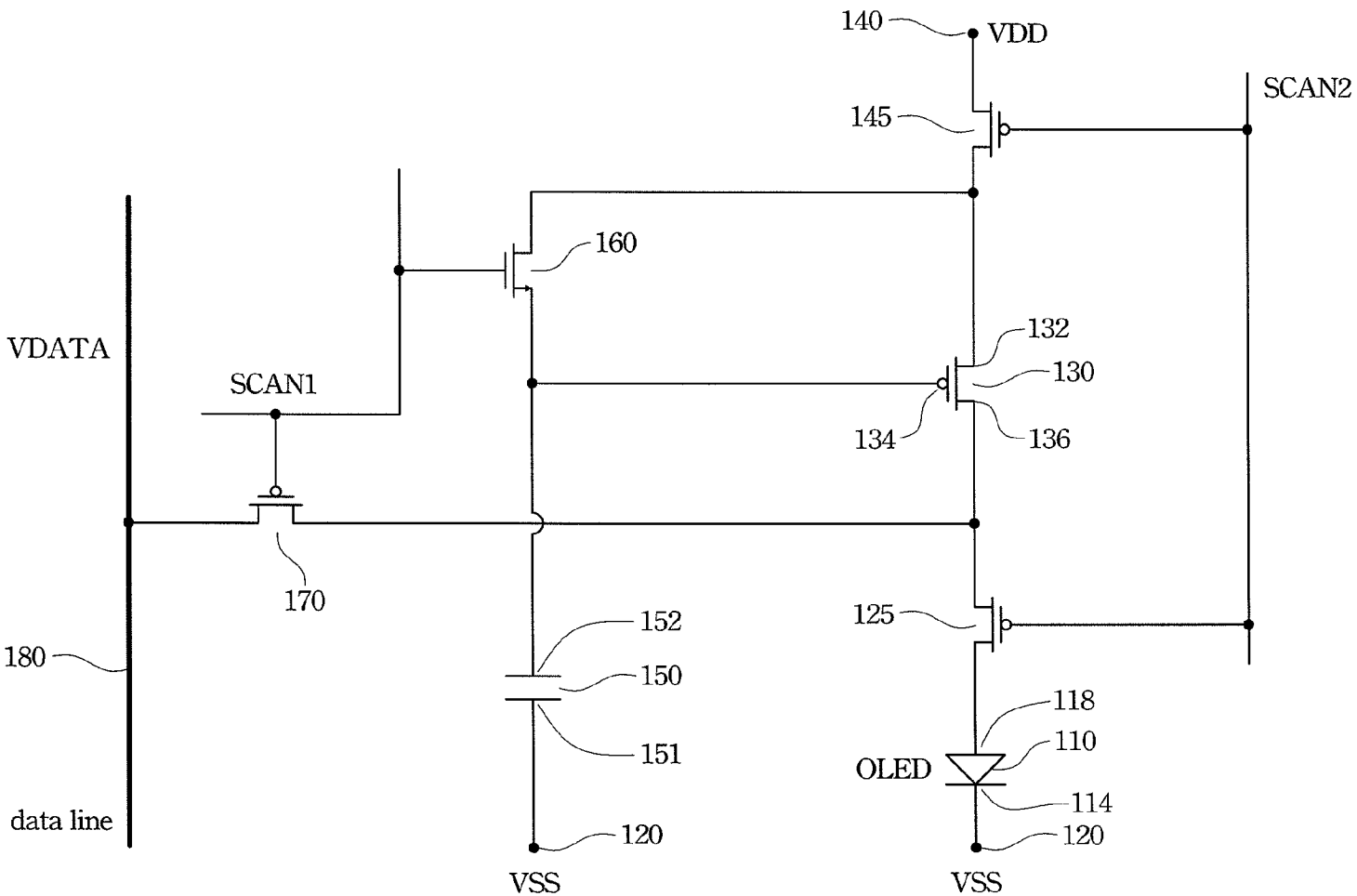
Fig. 1 (PRIOR ART)
FIG. 1 shows a light emitting diode pixel circuit of the prior art.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
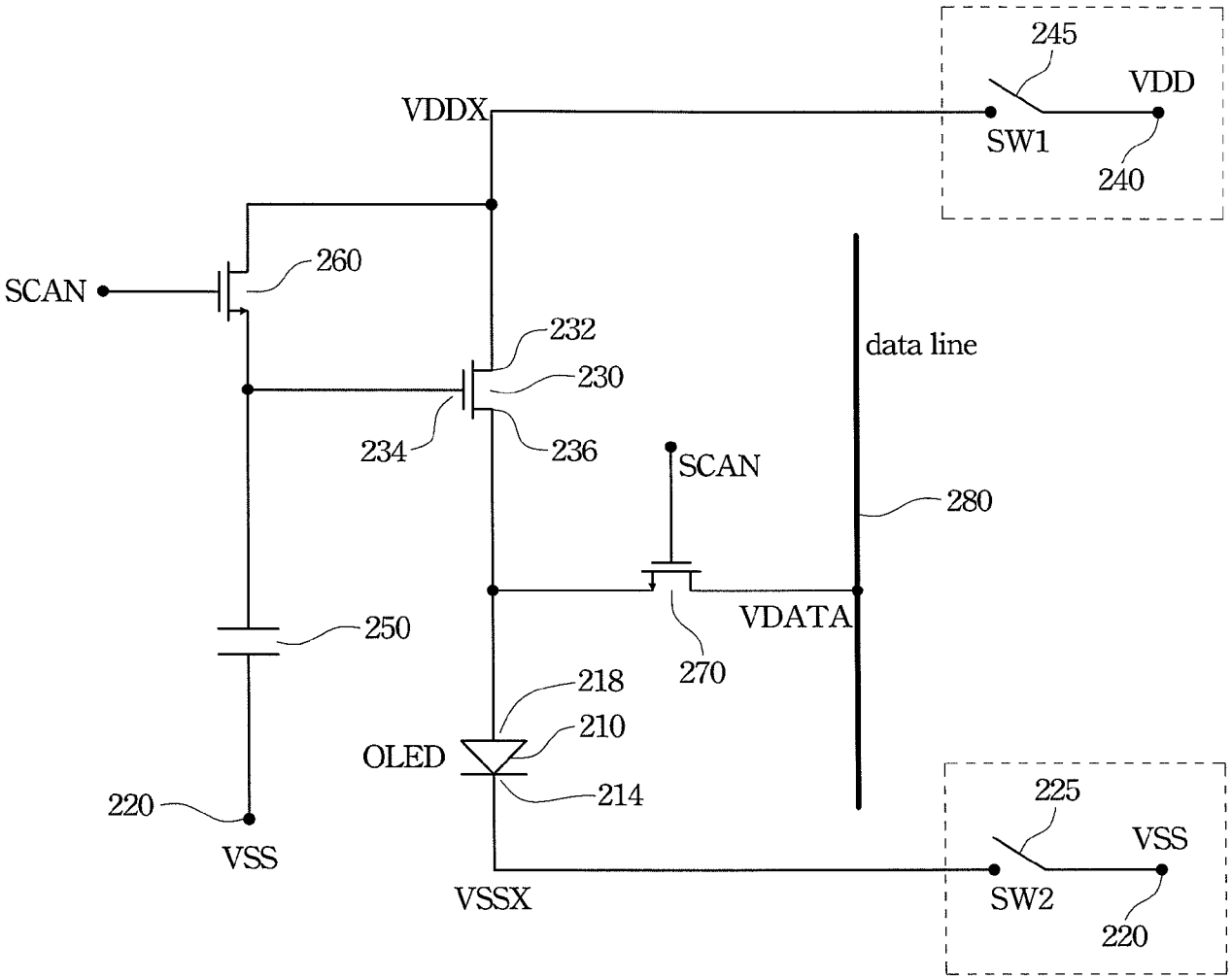
FIG. 2A shows a light emitting diode pixel circuit according to an embodiment of the invention.

FIG. 2A shows a light emitting diode pixel circuit according to an embodiment of the invention. The pixel circuit is a voltage type compensation pixel circuit. The pixel circuit has a light emitting diode 210, a first switch 225, a driving transistor 230, a second switch 245, a capacitor 250, a third switch 260, and a fourth switch 270. The first switch 225 is coupled between a first end 214 of the light emitting diode 210 and a ground terminal 220. A drain 236 of the driving transistor 230 is coupled to a second end 218 of the light emitting diode 210. The second switch 245 is coupled between a source 232 of the driving transistor 230 and a power source terminal 240. The capacitor 250 is coupled between a gate 234 of the driving transistor 230 and the ground terminal 220. The third switch 260, controlled by a first scan signal (SCAN), is coupled between the source 232 and the gate 234 of the driving transistor 230. The fourth switch 270, also controlled by the first scan signal (SCAN), is coupled between the second end 218 of the light emitting diode 210 and a data line 280.

A gate driver provides the voltages for the power source terminal 240 and the ground terminal 220. The first switch 225 and the second switch 245 could be configured in the gate driver, outside the pixel circuit, to reduce the number of the transistors inside the pixel circuit.

The first switch 225, controlled by a signal (SW2), is to couple or decouple the first end 214 of the light emitting diode 210 and the ground terminal 220. The second switch 245, controlled by a signal (SW1), is to couple or decouple the source 232 of the driving transistor 230 and the power source terminal 240. The first switch 225, the second switch 245, the third switch 260, and the fourth switch 270 are transistors.

Figure 2B:
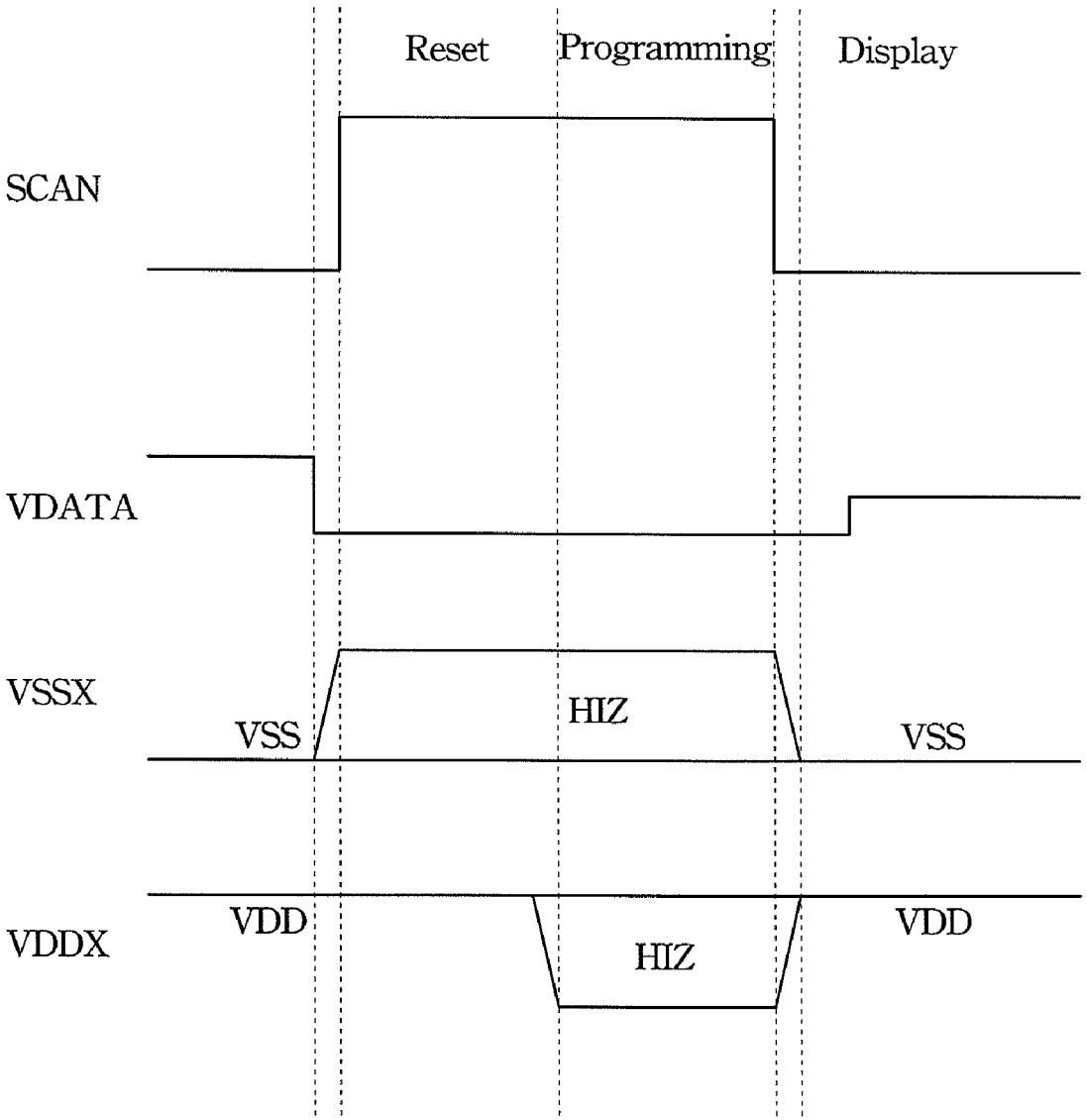
FIG. 2B shows the waveform diagrams of the signals of the embodiment shown in FIG. 2A.

FIG. 2B shows the waveform diagrams of the signals of the embodiment shown in FIG. 2A. The pixel circuit operates in a reset period, a programming period, and a display period sequentially. During the reset period, the first switch 225 is turned off, the second switch 245 is turned on, and the third switch 260 is turned on; during the programming period, the first switch 225 is turned off, the second switch 245 is turned off, and the third switch 260 is turned on; and during the display period, the first switch 225 is turned on, the second switch 245 is turned on, and the third switch 260 is turned off. The scan signal (SCAN) is asserted to turn on the third switch 260 and the forth switch 270 during the reset period and the programming period, and de-asserted to turn off the third switch 260 and the forth switch 270 during the display period. During the programming period, the scan signal (SCAN) is asserted to turn on the third switch 260 and the forth switch 270, and the data signals (VDATA) from the data line 280 are transmitted to the pixel circuit.

From the description above, we can conclude that the aperture ratio of the pixel circuit is increased since the number of the transistors inside the pixel circuit is reduced. Also, the pixel circuit uses only one control signal (SCAN). The first switch 225 and the second switch 245 can be made with big sizes to lower the power consumption. However, there is an IR drop issue during the display period, so the pixel circuit is suitable for the medium or small sized pixel circuit.

Figure 2C:
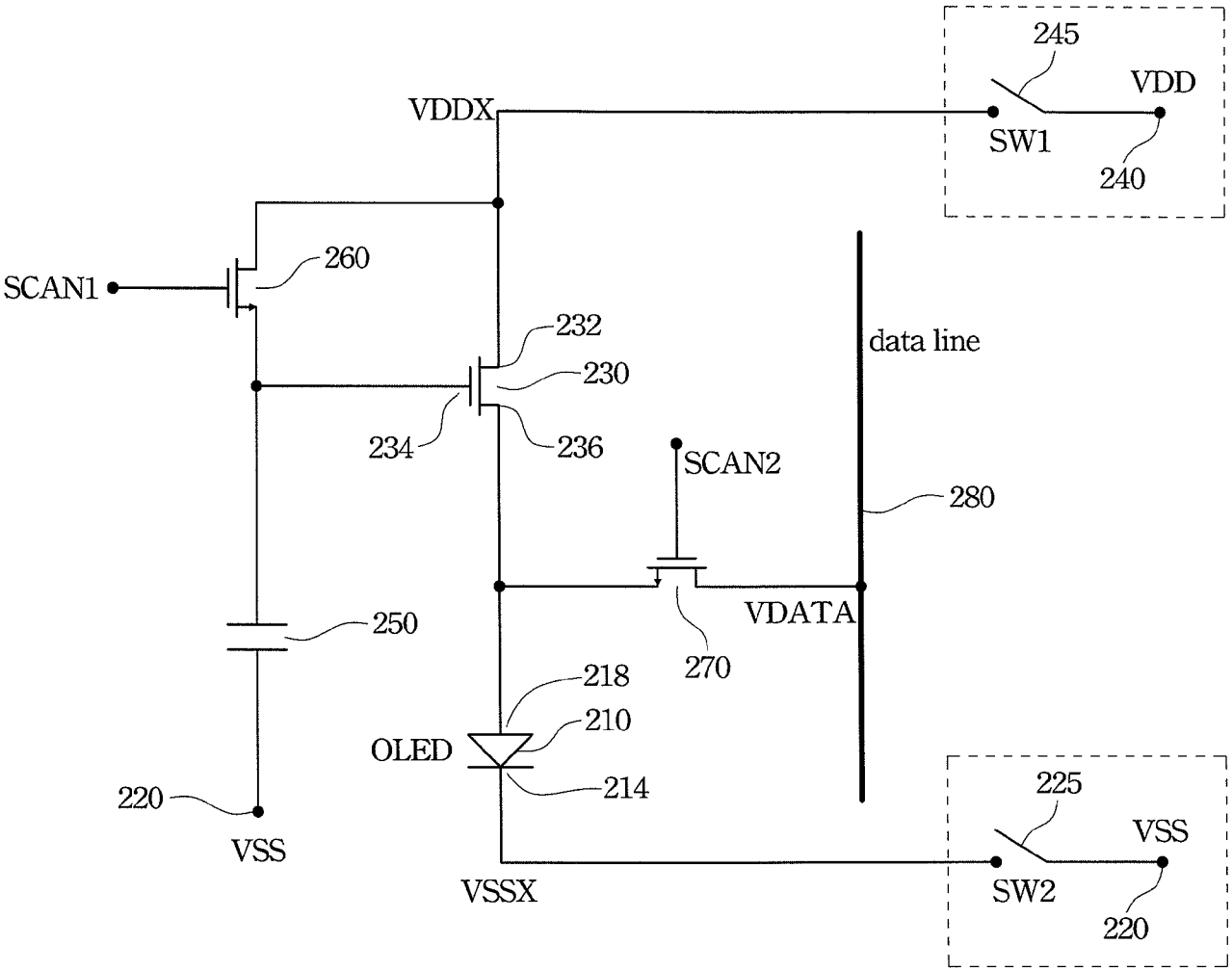
FIG. 2C shows a light emitting diode pixel circuit according to another embodiment of the invention.

FIG. 2C shows a light emitting diode pixel circuit according to another embodiment of the invention. The pixel circuit is a voltage type compensation pixel circuit. The pixel circuit has a light emitting diode 210, a first switch 225, a driving transistor 230, a second switch 245, a capacitor 250, a third switch 260, and a fourth switch 270. The first switch 225 is coupled between a first end 214 of the light emitting diode 210 and a ground terminal 220. A drain 236 of the driving transistor 230 is coupled to a second end 218 of the light emitting diode 210. The second switch 245 is coupled between a source 232 of the driving transistor 230 and a power source terminal 240. The capacitor 250 is coupled between a gate 234 of the driving transistor 230 and the ground terminal 220. The third switch 260, controlled by a first scan signal (SCAN1), is coupled between the source 232 and the gate 234 of the driving transistor 230. The fourth switch 270, controlled by a second scan signal (SCAN2), is coupled between the second end 218 of the light emitting diode 210 and a data line 280.

A gate driver provides the voltages for the power source terminal 240 and the ground terminal 220. The first switch 225 and the second switch 245 could be configured in the gate driver, outside the pixel circuit, to reduce the number of the transistors inside the pixel circuit.

The first switch 225, controlled by a signal (SW2), is to couple or decouple the first end 214 of the light emitting diode 210 and the ground terminal 220. The second switch 245, controlled by a signal (SW1), is to couple or decouple the source 232 of the driving transistor 230 and the power source terminal 240. The first switch 225, the second switch 245, the third switch 260, and the fourth switch 270 are transistors.

Figure 2D:
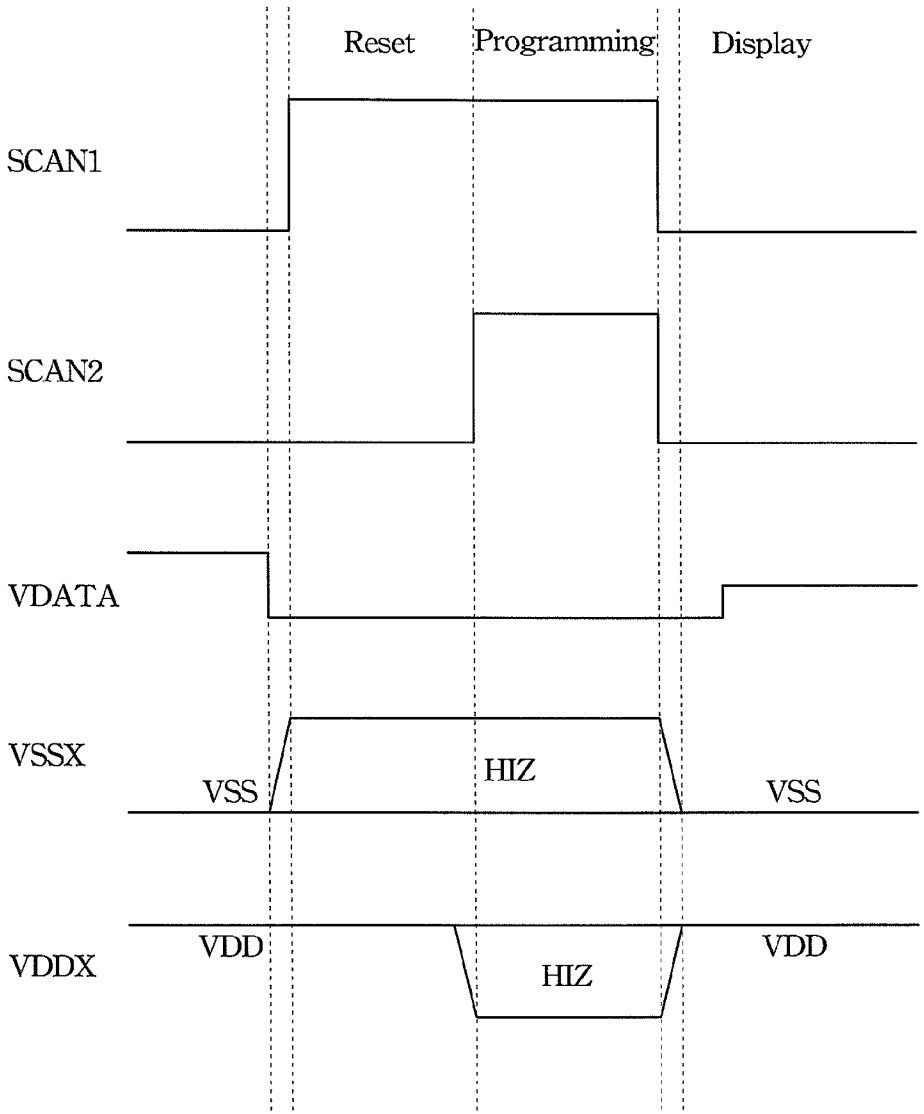
FIG. 2D shows the waveform diagrams of the signals of the embodiment shown in FIG. 2C.

FIG. 2D shows the waveform diagrams of the signals of the embodiment shown in FIG. 2C. The pixel circuit operates in a reset period, a programming period, and a display period sequentially. During the reset period, the first switch 225 is turned off, the second switch 245 is turned on, the third switch 260 is turned on, and the forth switch 270 is turned off; during the programming period, the first switch 225 is turned off, the second switch 245 is turned off, the third switch 260 is turned on, and the forth switch 270 is turned on; and during the display period, the first switch 225 is turned on, the second switch 245 is turned on, the third switch 260 is turned off, and the forth switch 270 is turned off. The first scan signal (SCAN1) is asserted to turn on the third switch 260 during the reset period and the programming period, and de-asserted to turn off the third switch 260 during the display period. The second scan signal is asserted to turn on the forth switch during the programming period, and de-asserted to turn off the forth switch during the reset and display period. During the programming period, the first scan signal (SCAN1) and the second scan signal (SCAN2) are asserted to turn on the third switch 260 and the forth switch 270, and the data signals (VDATA) from the data line 280 are transmitted to the pixel circuit.

From the description above, we can conclude that the aperture ratio of the pixel circuit is increased since the number of the transistors inside the pixel circuit is reduced. Also, the first switch 225 and the second switch 245 can be made with big sizes to lower the power consumption. However, there is an IR drop issue during the display period, so the pixel circuit is suitable for the medium or small sized pixel circuit.

The difference between the embodiment of FIG. 2A and FIG. 2C is that the forth switch 270 is controlled by the second scan signal (SCAN2). Since the second scan signal (SCAN2) is de-asserted to turn off the forth switch during the reset period, the second end 218 of the light emitting diode 210 is floating. As a result, this resolves the issue of current path in the pixel circuit.

Figure 3A:
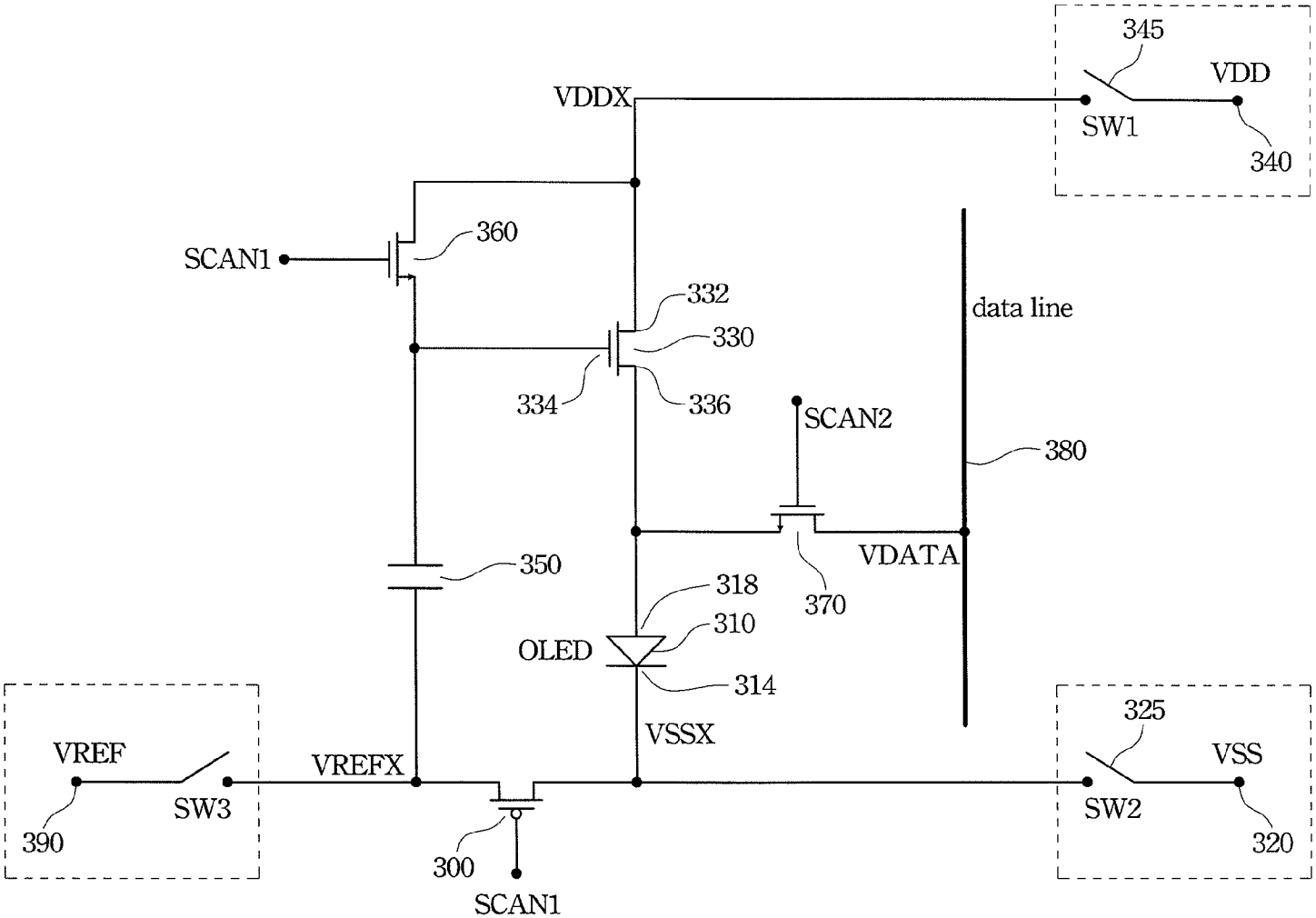
FIG. 3A shows a light emitting diode pixel circuit according to another embodiment of the invention.

FIG. 3A shows a light emitting diode pixel circuit according to another embodiment of the invention. The pixel circuit is a voltage type compensation pixel circuit. The pixel circuit has a light emitting diode 310, a driving transistor 330, a capacitor 350, a third switch 360, and a fourth switch 370. The organic light emitting diode 310 is coupled to a ground terminal 320 by a first switch 325. A source 332 of the driving transistor 330 is coupled to a power source terminal 340 by a second switch 345. A drain 336 of the driving transistor 330 is coupled to a positive pole 318 of the organic light emitting diode 310. The capacitor 350 is coupled between a gate 334 of the driving transistor 330 and a reference voltage terminal 390. The third switch 360 is coupled between the source/drain 332 and the gate 334 of the driving transistor 330. The fourth switch 370, controlled by a second scan signal (SCAN2), is coupled between the second end 318 of the light emitting diode 310 and a data line 380.

A gate driver provides the voltages for the power source terminal 340 and the ground terminal 320. The first switch 325 and the second switch 345 could be configured in the gate driver, outside the pixel circuit, to reduce the number of the transistors inside the pixel circuit.

The first switch 325, controlled by a signal (SW2), is to couple or decouple the first end 314 of the light emitting diode 310 and the ground terminal 320. The second switch 345, controlled by a signal (SW1), is to couple or decouple the source 332 of the driving transistor 330 and the power source terminal 340. The first switch 325, the second switch 345, the third switch 360, and the fourth switch 370 are transistors. A reference voltage terminal 390 is arranged to adjust a voltage range of the data signal written into the capacitor 350.

Figure 3B:
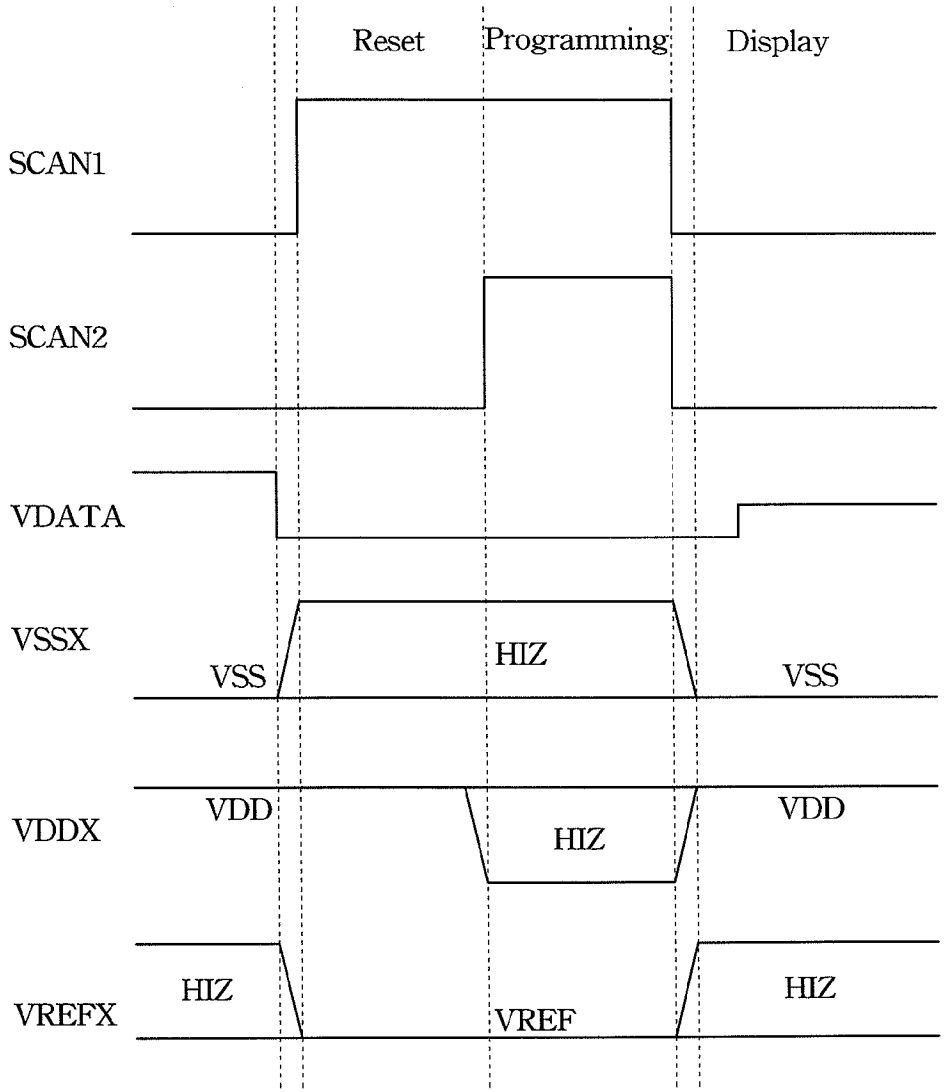
FIG. 3B shows the waveform diagrams of the signals of the embodiment shown in FIG. 3A.

FIG. 3B shows the waveform diagrams of the signals of the embodiment shown in FIG. 3A. The pixel circuit operates in a reset period, a programming period, and a display period sequentially. During the reset period, the first switch 325 is turned off, the second switch 345 is turned on, the third switch 360 is turned on, and the forth switch 370 is turned off; during the programming period, the first switch 325 is turned off, the second switch 345 is turned off, the third switch 360 is turned on, and the forth switch 370 is turned on; and during the display period, the first switch 325 is turned on, the second switch 345 is turned on, the third switch 360 is turned off, and the forth switch 370 is turned off. The first scan signal (SCAN1) is asserted to turn on the third switch 360 during the reset period and the programming period, and de-asserted to turn off the third switch 360 during the display period. The second scan signal is asserted to turn on the forth switch 360 during the programming period, and de-asserted to turn off the forth switch 360 during the reset and display period.

Compared with the prior art, the aperture ratio of the pixel circuit is increased since the number of the transistors inside the pixel circuit is reduced. Also, the first switch 325 and the second switch 345 can be made with big sizes to lower the power consumption. Since the second scan signal SCAN2 is de-asserted to turn off the forth switch 370 during the reset period, the second end 318 of the light emitting diode 310 is floating. As a result, no current path exists in the pixel circuit. Moreover, during the display period, a short circuit between the capacitor 350 and the first end 314 of the light emitting diode 310 can improve the IR drop issue across the short.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pixel circuit operates during a reset period, a programming period, and a display period sequentially, comprising:
- a light emitting diode;
- a first switch coupled between a first end of the light emitting diode and a ground terminal;
- a driving transistor having a drain coupled to a second end of the light emitting diode;
- a second switch coupled between a source of the driving transistor and a power source terminal;
- a capacitor coupled between a gate of the driving transistor and the ground terminal; and
- a third switch controlled by a first scan signal and coupled between the source and the gate of the driving transistor;
- wherein the first switch is turned off, the second switch is turned on, and the third switch is turned on during the reset period; the first switch is turned off, the second switch is turned off, and the third switch is turned on during the programming period; the first switch is turned on, the second switch is turned on, and the third switch is turned off during the display period.

2. The pixel circuit as claimed in claim 1, further comprising a fourth switch coupled between the second end of the light emitting diode and a data line.

3. The pixel circuit as claimed in claim 2, wherein the fourth switch is controlled by the first scan signal.

4. The pixel circuit as claimed in claim 2, wherein the fourth switch is a transistor.

5. The pixel circuit as claimed in claim 2, wherein the fourth switch is controlled by a second scan signal.

6. The pixel circuit as claimed in claim 5, wherein the second scan signal is asserted during the programming period and de-asserted during the reset and display periods.

7. The pixel circuit as claimed in claim 1, wherein voltages of the power source terminal and the ground terminal are provided by a gate driver.

8. The pixel circuit as claimed in claim 7, wherein the first switch is configured in the gate driver.

9. The pixel circuit as claimed in claim 7, wherein the second switch is configured in the gate driver.

10. The pixel circuit as claimed in claim 1, wherein the first switch, the second switch and the third switch are transistors.

11. A pixel circuit operates during a reset period, a programming period, and a display period sequentially, comprising:
- a light emitting diode coupled to a ground terminal by a first switch, wherein the first switch is turned off during the reset and programming period, and turned on during the display period;
- a driving transistor having source/drains respectively coupled to a power source terminal by a second switch and coupled to a positive pole of the light emitting diode, wherein the second switch is turned off during the programming period, and turned on during the reset and display period;
- a capacitor coupled between a gate of the driving transistor and a reference voltage terminal; and
- a third switch coupling the source/drain and the gate of the driving transistor together when a first scan signal is asserted, wherein the scan signal is asserted during the reset and programming period, and de-asserted during the display period.

12. The pixel circuit as claimed in claim 11, further comprising a fourth switch coupled between the second end of the light emitting diode and a data line.

13. The pixel circuit as claimed in claim 12, wherein the fourth switch is controlled by the first scan signal.

14. The pixel circuit as claimed in claim 12, wherein the fourth switch is a transistor.

15. The pixel circuit as claimed in claim 12, wherein the fourth switch is controlled by a second scan signal.

16. The pixel circuit as claimed in claim 15, wherein the second scan signal is asserted during the programming stage, and de-asserted during the reset and display stages.

17. The pixel circuit as claimed in claim 11, wherein voltages of the power source terminal and the ground terminal are provided by a gate driver.

18. The pixel circuit as claimed in claim 17, wherein the first switch is configured in the gate driver.

19. The pixel circuit as claimed in claim 17, wherein the second switch is configured in the gate driver.

20. The pixel circuit as claimed in claim 11, wherein the first switch, the second switch and the third switch are transistors.

21. The pixel circuit as claimed in claim 11, wherein the reference voltage terminal is arranged to adjust a voltage range of the data signal written into the capacitor.

* * * * *